US008763524B2

(12) United States Patent
Dumenil

(10) Patent No.: US 8,763,524 B2
(45) Date of Patent: Jul. 1, 2014

(54) PRINTING MACHINE

(75) Inventor: François Dumenil, Chaumes en Brie (FR)

(73) Assignee: Machines Dubuit, Noisy le Grand (FR)

( * ) Notice: Subject to any disclaimer, the term of this patent is extended or adjusted under 35 U.S.C. 154(b) by 1074 days.

(21) Appl. No.: 12/489,707

(22) Filed: Jun. 23, 2009

(65) Prior Publication Data

US 2009/0320699 A1 Dec. 31, 2009

(30) Foreign Application Priority Data

Jun. 24, 2008 (FR) ..... 08 54198

(51) Int. Cl.
*B41F 17/00* (2006.01)
*B41F 17/22* (2006.01)

(52) U.S. Cl.
CPC ..... *B41F 17/22* (2013.01)
USPC ..... 101/37; 101/40; 101/40.1

(58) Field of Classification Search
USPC ..... 101/35, 37, 40, 40.1, 115, 126
See application file for complete search history.

(56) References Cited

U.S. PATENT DOCUMENTS

| | | | | |
|---|---|---|---|---|
| 3,741,116 | A * | 6/1973 | Green et al. | 101/287 |
| 4,543,152 | A * | 9/1985 | Nozaka | 156/502 |
| 5,449,409 | A * | 9/1995 | Baccini | 118/668 |
| 6,370,748 | B1 * | 4/2002 | Baccini | 29/33 M |
| 6,374,729 | B1 * | 4/2002 | Doyle | 101/114 |
| 7,775,158 | B2 * | 8/2010 | Ando | 101/127.1 |
| 2003/0121428 | A1 * | 7/2003 | Kamen et al. | 101/38.1 |
| 2004/0177779 | A1 * | 9/2004 | Steffen et al. | 101/228 |
| 2005/0066826 | A1 * | 3/2005 | Dubuit et al. | 101/126 |
| 2006/0249039 | A1 * | 11/2006 | Feldman et al. | 101/115 |
| 2007/0022883 | A1 | 2/2007 | Dubuit et al. | |
| 2007/0099462 | A1 * | 5/2007 | Helma et al. | 439/159 |
| 2007/0236110 | A1 * | 10/2007 | Kling | 312/34.4 |
| 2007/0240588 | A1 | 10/2007 | Dumenil | |
| 2008/0034990 | A1 | 2/2008 | Hilpert et al. | |
| 2008/0110034 | A1 * | 5/2008 | Schnak et al. | 30/526 |
| 2009/0314201 | A1 * | 12/2009 | Baccini | 118/500 |
| 2012/0048132 | A1 * | 3/2012 | Baccini et al. | 101/118 |

FOREIGN PATENT DOCUMENTS

| | | |
|---|---|---|
| EP | 1 844 931 | 10/2007 |
| FR | 2 896 577 | 12/2006 |

OTHER PUBLICATIONS

French Search Report dated Feb. 27, 2009, from corresponding French application.

* cited by examiner

*Primary Examiner* — David Banh
(74) *Attorney, Agent, or Firm* — Young & Thompson

(57) ABSTRACT

A printing machine includes: a frame a tower which is driven in rotation relative to the frame in order to move an object to be printed between at least a printing station, an introduction station and/or discharge station; a conveyor which is capable of introducing or discharging the object to be printed to/from the introduction station and/or discharge station; a transfer device including a conveyor web portion which is capable of moving the object to be printed between the conveyor and the tower. The machine includes an element for driving the conveyor web portion of the transfer device, the drive element being carried by the frame, each transfer device including a transmission element which can be disengaged from the drive element.

20 Claims, 7 Drawing Sheets

PRINTING MACHINE

The present invention relates to a printing machine of the type comprising:

a frame;

a tower which is carried by the frame, the tower being driven in rotation relative to the frame about an axis of rotation A-A in order to move an object to be printed between at least a printing station, an introduction station and/or discharge station for the object to be printed;

a conveyor which is carried by the frame, the conveyor being capable of introducing or discharging the object to be printed to/from the introduction station and/or discharge station;

a transfer device which is carried by the tower, the transfer device comprising a conveyor web portion which is capable of moving the object to be printed between the conveyor and the tower; and a printing device which is capable of printing the object to be printed, the printing device being provided at the printing station.

The invention particularly relates to a machine for printing fragile objects, such as silicon plates having a thickness of less than one millimetre.

BACKGROUND OF THE INVENTION

A layer of silver is, for example, printed on those plates in order to construct solar collectors.

Those plates are processed by various machines which are provided one behind the other in a linear processing line. The printing step is carried out in the middle of other processing steps so that the printing machine comprises at least a station for introducing the object, a station for printing and a station for discharging the object separate from the introduction station.

In this type of printing machine, the objects to be printed are brought to the introduction station of the printing machine by an introduction conveyor. The objects are moved from the introduction conveyor towards the tower by a transfer device which is carried by the tower. Subsequently, the objects are moved by the tower being rotated towards the printing station, then towards the discharge station of the tower. Finally, the transfer device transports the object towards a discharge conveyor. Therefore, the tower carries a number of transfer devices and a number of means for driving those transfer devices that is equal to the number of stations of the machine. Since the machine comprises an introduction station, a printing station and a discharge station, this number is a minimum of three.

Consequently, this type of machine takes up a large amount of space. This type of machine further requires means for rotating the tower which are powerful owing to the great weight thereof.

SUMMARY OF THE INVENTION

An object of the present invention is to provide a printing machine which is capable of printing fragile objects and which does not have the disadvantages set out above.

To that end, the invention relates to a printing machine which comprises means for driving the conveyor web portion of the transfer device, the drive means being carried by the frame, each transfer device comprising a transmission element which can be disengaged from the drive means.

According to specific embodiments, the machine comprises one or more of the following features taken in isolation or in combination:

the transfer device comprises:

a support platen, two arms for supporting the conveyor web portion which are fixed to the support platen, the support arms being parallel, two arms for movingly driving the conveyor web portion, the driving arms being capable of moving relative to the support platen, and retention means which are capable of maintaining the conveyor web portion tensioned between the support arms and the driving arms, the conveyor web portion being in contact with an outer face of each support arm and with an inner face of each driving arm;

the conveyor comprises at least one web for carrying the object to be printed, the machine comprising a unit for controlling the conveyor and the drive means, the control unit being capable of adjusting the speed and acceleration of the driving arms to the speed and acceleration of the carrying web;

the control unit is capable of actuating a movement speed of the driving arms equal to half of the movement speed of the carrying web;

the transfer device comprises a device for renewing the conveyor web portion comprising:

a first reel which is fixed to the support platen, a web portion which is intended to transport the objects to be printed being wound around the first reel, a second reel which is fixed to the support platen, a web portion which has transported the objects to be printed being wound around the second reel; the web portion wound on the first reel, the conveyor web portion and the web portion wound on the second reel forming a continuous paper web, and wherein the retention means are capable of being unlocked in order to authorise rotation of the first reel at least in an unwinding direction, and rotation of the second reel at least in a winding direction in order to renew the conveyor web portion;

the retention means comprise an electromagnetic brake with which the first reel is provided and a free wheel with which the second reel is provided;

the transmission element is connected to the driving arms and the drive means comprise:

a connection element which is capable of being connected to the transmission element, first movement means which are capable of moving the connection element in a first direction over a first trajectory in order to connect and disconnect the connection element to/from the transmission element, and second movement means which are capable of driving the connection element so as to move in a second direction different from the first direction in order to move the driving arms in accordance with a back and forth movement when the connection element is connected to the transmission element;

the transmission element comprises:

a support plate which is capable of moving relative to the support platen in the second direction and at least one column which is carried by the support platen, the or each column being capable of moving relative to the support platen in the first direction and second direction;

the transfer device comprises locking means which are capable of locking the driving arms in terms of movement in the second direction when the driving arms are in at least a travel end position of the back and forth movement;

the locking means comprise:

a locking roller which is fixedly joined to the or each column, at least one notch which is formed in the support platen and which is capable of receiving the locking roller and resilient means which are capable of moving the locking roller into the or each notch, the resilient means being fixed to the column and to the support plate;

the first movement means are capable of moving the connection element along a second trajectory at the travel start and/or end of the back and forth movement of the driving arms in order to move the locking roller out of the or each notch;

the machine comprises a device for driving in rotation the second reel in a winding direction, the driving device being fixedly joined to the frame, the transfer device comprises:

a detector for the number of back and forth movements of the driving arms, and a control unit which is capable of actuating the device for driving the second reel and the unlocking of the retention means when the detected number exceeds a defined threshold.

BRIEF DESCRIPTION OF THE DRAWINGS

The invention will be better understood from a reading of the following description which is given purely by way of example with reference to the appended drawings in which.

DETAILED DESCRIPTION OF THE PREFERRED EMBODIMENTS

Figure 1:
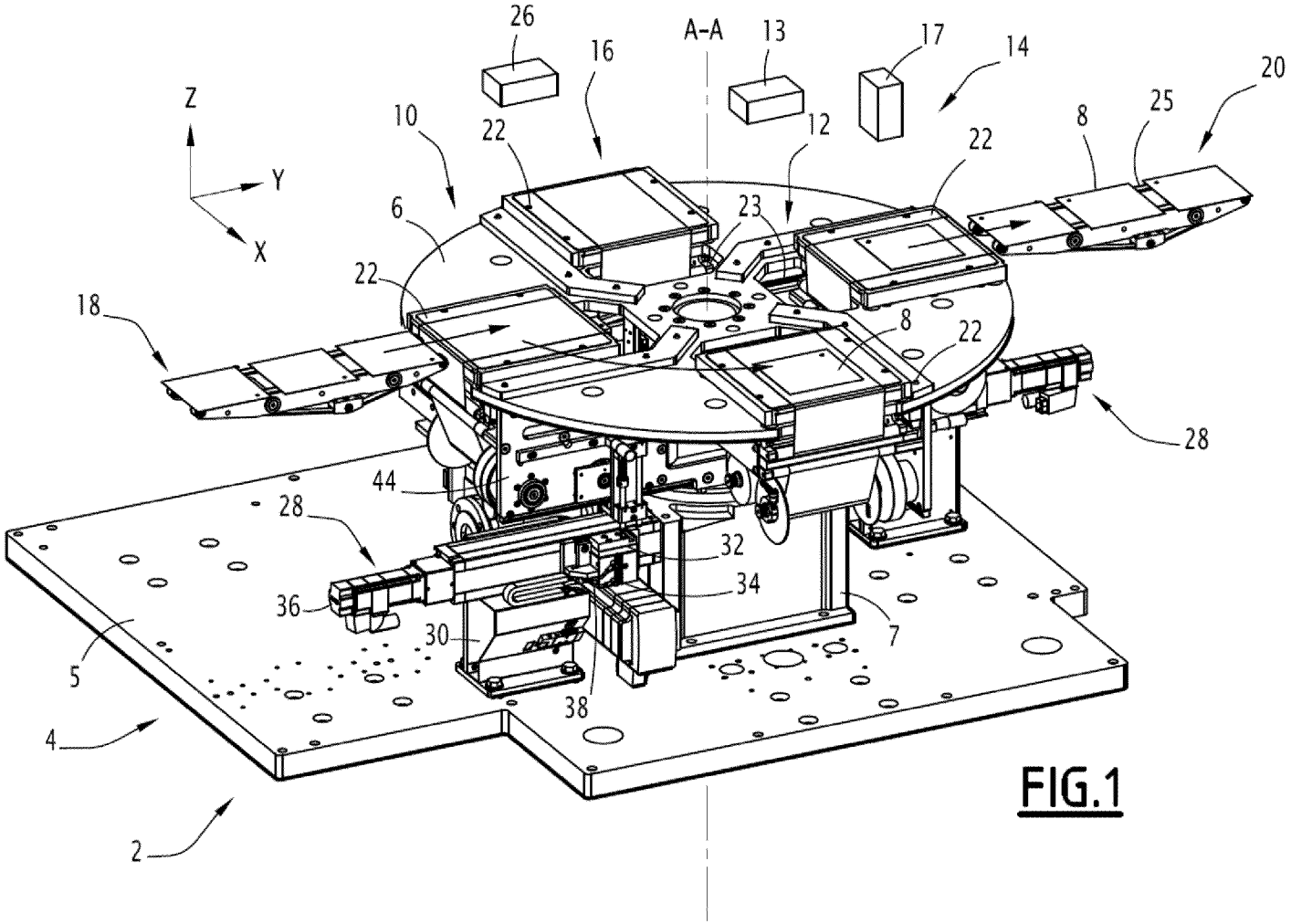
FIG. 1 is a perspective view of a face of the printing machine according to the invention.

With reference to FIG. 1, the printing machine 2 comprises a frame 4, a tower 6 which is surrounded by work stations and means for driving the tower in rotation which are not illustrated in the FIGS.

The frame 4 is constituted by a support 5, to which there is fixed a casing 7 which is capable of carrying the tower 6 and containing the drive means thereof.

The drive means are capable of driving the tower in rotation about a vertical axis of rotation A-A in order to move an object 8 to be printed from an introduction station 10 towards a printing station 12, from the printing station 12 towards a discharge station 14 of the line for processing the object or towards a station 16 for discharging damaged objects, and finally from the discharge station 14 or 16 towards the introduction station 10 in order to recover a new object to be printed.

The printing station 12 is provided with a printing device 13, for example, by means of serigraphy, illustrated schematically in FIG. 1.

The discharge station 14 is provided with a camera 17 and means for processing images which are capable of verifying that the object 8 to be printed has not been damaged or broken during the preceding steps.

The printing machine 2 further comprises a conveyor 18 for introducing the objects 8 to be printed that is adjacent to the introduction station 10, a conveyor 20 for discharging the objects to be printed that is adjacent to the discharge station 14 and four devices 22 for transferring the objects that are fitted in openings 23 of the tower 6.

The transfer devices 22 are capable of transferring the objects from the introduction conveyor 18 towards the tower 6 and from the tower 6 towards the discharge conveyor 20 separate from the introduction conveyor 18.

The conveyors 18 and 20 extend linearly in the same direction Y in order to move the object to be printed towards different processing machines of the processing line.

Each of the conveyors 18, 20 comprises a step motor and two carrying webs 25 which are fixed in a loop and which are driven in terms of movement by the step motor.

The printing machine 2 further comprises a control unit 26 and two means 28 for driving the transfer devices 22 which are provided at the introduction station 10 and discharge station 14.

The control unit 26 is capable of controlling the means for driving the tower 6 in rotation, the introduction conveyor 18 and discharge conveyor 20 and the means 28 for driving the transfer devices, as explained below.

In particular, the control unit 26 is capable of controlling the speed of rotation and the stopping of the tower 6 at each station 12, 14 and 16 and the movement speed of the carrying webs 25 of the conveyors 18, 20 so that it is equal to the movement speed of the objects on the transfer devices 22.

The drive means 28 of the transfer devices are carried by the support 5 and are fixed thereto. The drive means 28 comprise a casing 30 and a connection support 32 which are provided with housings 34.

The drive means 28 further comprise a step-down motor 36, means for converting the rotational movement of the output shaft of the step-down motor into a translational movement of the connection support 32 in a first horizontal direction Y and a pneumatic jack 38 which is capable of moving the connection support 32 in a second vertical direction Z.

Figure 2:
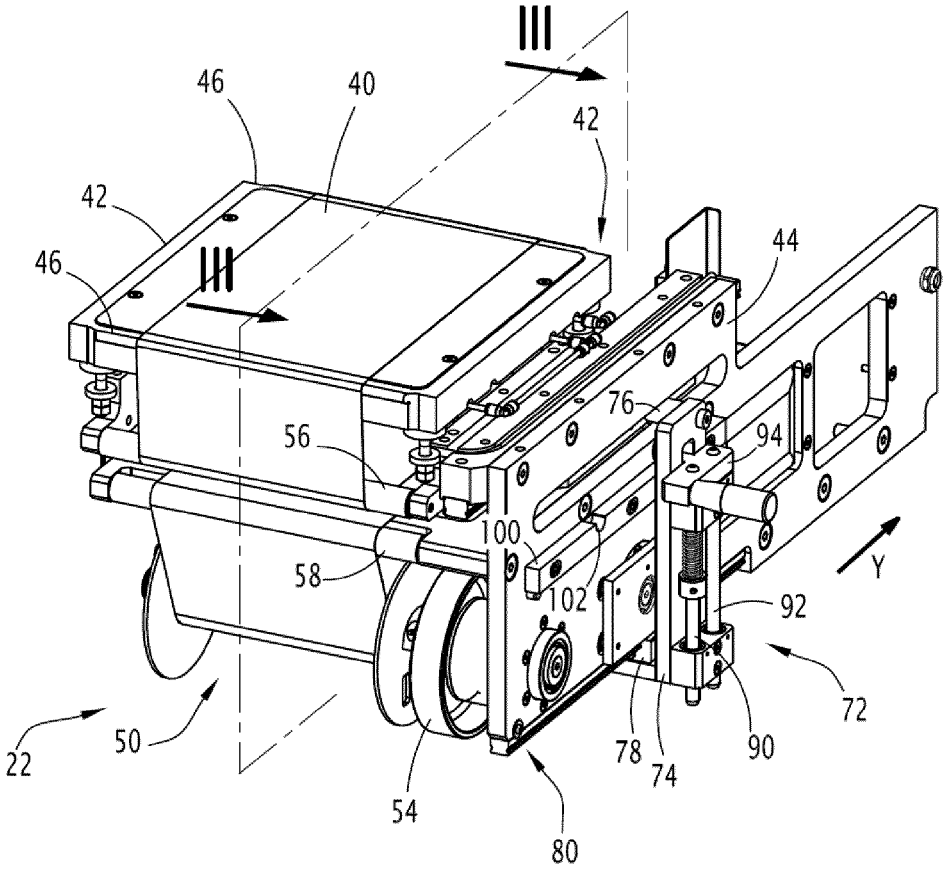
FIG. 2 is a perspective view of the transfer device used in the printing machine according to the invention.
Figure 3:
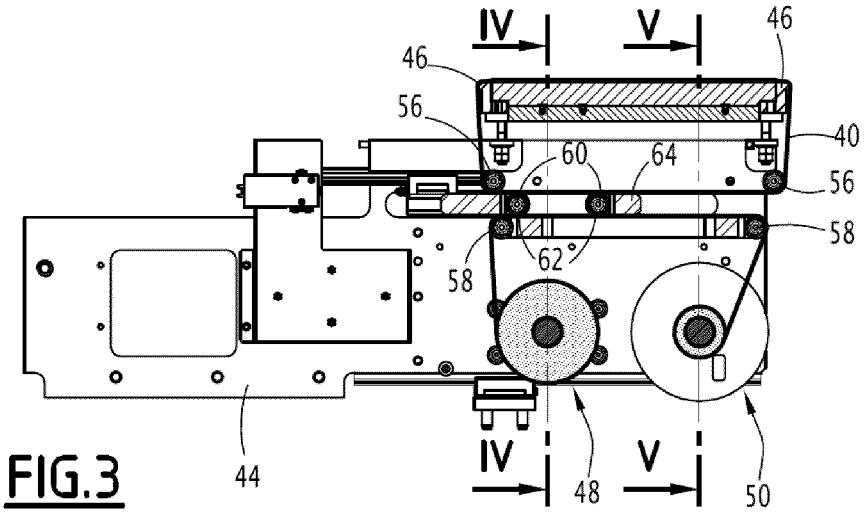
FIG. 3 is a longitudinal section of the transfer device in accordance with a section plane III-III illustrated in FIG. 2.

With reference to FIGS. 2 and 3, each transfer device 22 comprises a paper web portion 40 which is capable of moving an object 8 to be printed, a frame 42 for supporting the web portion 40 whose edges are intended to move into abutment against the rim of the openings 23 of the tower 6, and a support platen 44 which is fixed to the frame 42 and which extends in a vertical plane.

The support frame 42 is formed by four arms which are fixed to each other in order to form a frame. According to the invention, the two arms which are parallel with a tangent relative to the tower 6 located in the region of the transfer device form arms 46 for supporting the web portion 40. Those support arms 46 are located in a first horizontal plane.

The web portion 40 forms part of a longer web, a portion of which is wound around a first reel 48 and the other portion of which is wound around a second reel 50.

The first reel 48 and second reel 50 are fixed to the platen 44 in such a manner that their axes are parallel with the support arm 46.

The web portion wound around the first reel 48 is an unused web portion, that is to say, a web portion which is intended to be used to transport the objects to be printed.

The web portion wound around the second reel 50 is a used web portion, that is to say, a web portion which has already been used in order to transport objects to be printed.

Figure 4:
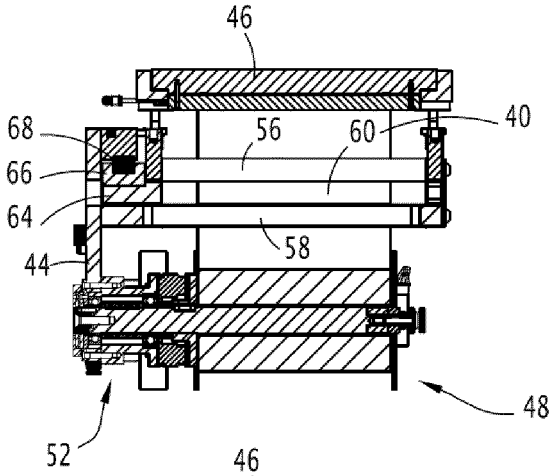
FIG. 4 is a cross-section of the transfer device in accordance with a section plane IV-IV illustrated in FIG. 3.

The first reel 48 is provided with an electromagnetic brake 52 which is illustrated in FIG. 4. The brake 52 is capable of preventing rotation of the first reel 48.

The control unit 26 is capable of engaging or disengaging the brake 52.

Figure 5:
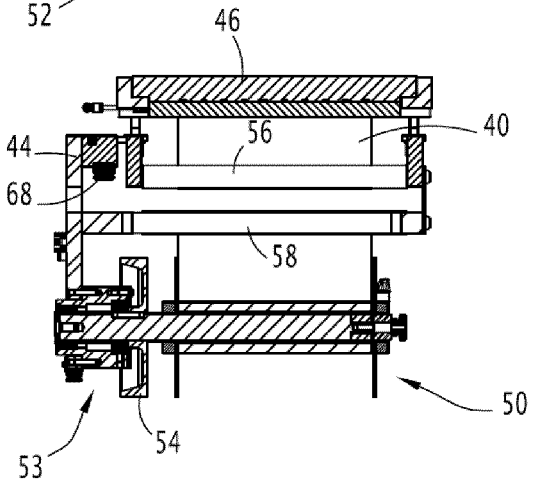
FIG. 5 is a cross-section of the transfer device in accordance with a section plane V-V illustrated in FIG. 3.

The second reel 50 is provided with a free wheel 53 which is illustrated in FIG. 5 in such a manner that it can pivot about the axis thereof only in a winding direction E of the web.

A bell-like member 54 is mounted so as to be fixed in rotation relative to the second reel 50. That bell-like member 54 is intended to allow the second reel 50 to be driven in the winding direction E in order to renew the web portion 40 when it is used.

The support platen 44 is provided with the first, second and third sets of rollers 56, 58, 60 illustrated in FIGS. 3 to 5.

The rollers 56 of the first set of rollers are fixed to the platen 44 parallel with the support arms 46 and in a second plane which is provided below the first plane of the support frame 42.

The rollers 58 of the second set are fixed to the platen 44 parallel with the support arms 46 and in a third plane which is provided below the second plane.

The rollers 60 of the third set are carried by the platen 44 in such a manner that they are arranged parallel with the support arm 46 and are located in a fourth plane which is provided between the second plane and the third plane.

The conveyor web portion 40 is successively engaged around the set of rollers 56 which are carried by the platen 44, the set of rollers 60 which are carried by the lifting block 64 and the set of rollers 58 which are carried by the platen 44.

In particular, the conveyor web portion 40 is in contact with the outer face of the rollers 58 of the second set, the inner face of the rollers 60 of the third set and the outer face of the rollers 56 of the first set.

In particular, the web portion 40 is kept tensioned between the sets of rollers 56, 58, 60 and the support arms 46.

According to the present invention, the term "inner" is intended to signify a face which is arranged towards the interior of the transfer device 22 and the term "outer" is intended to designate a face which is directed towards the exterior of the transfer device 22.

Figure 6:
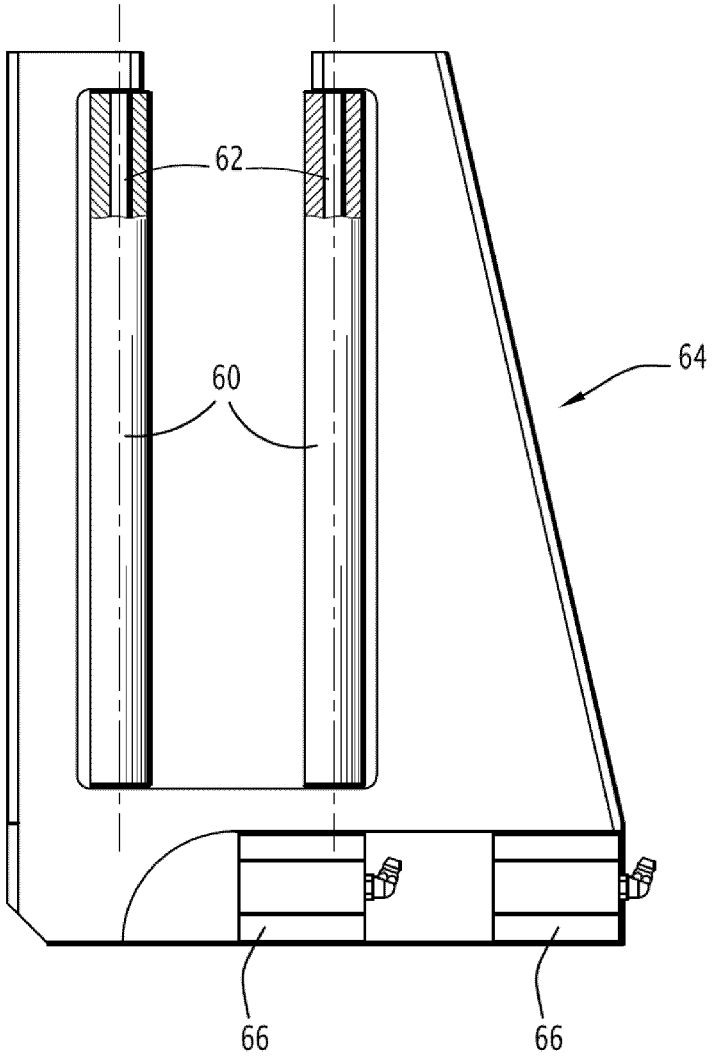
FIG. 6 is a top view of a lifting block used in the transfer device illustrated in FIG. 3.
Figure 7:
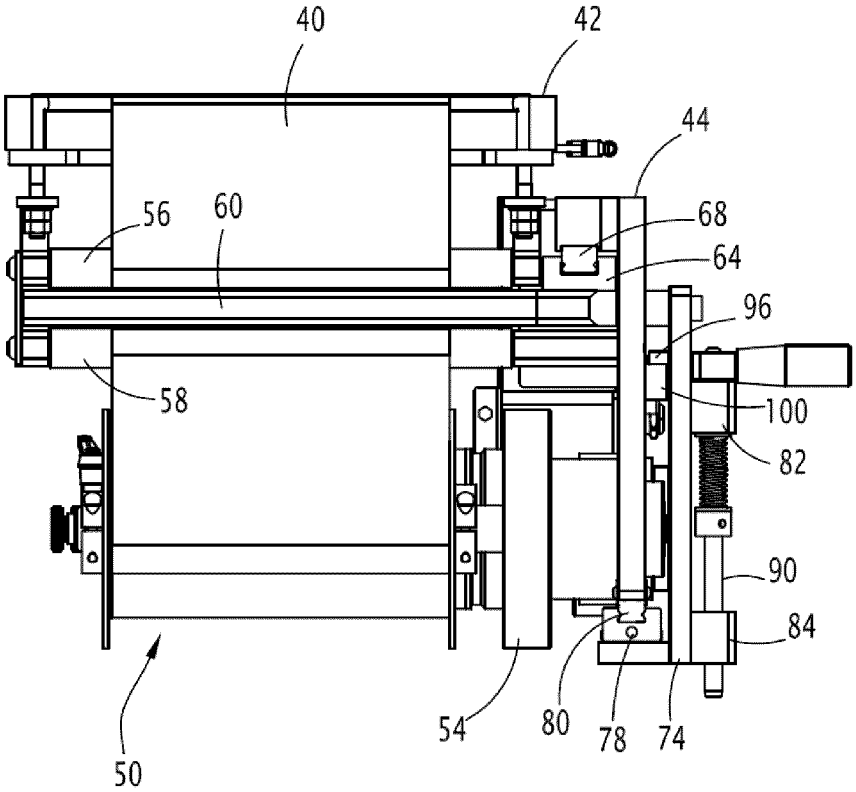
FIG. 7 is a front view of the transfer device illustrated in FIG. 2.

With reference to FIG. 6, the rollers 60 of the third set are articulated about two arms 62 of a lifting block 64, hereinafter referred to as driving arms of the web portion 40.

The lifting block 64 is provided with a slide 66 which is capable of sliding in a rail 68 which is fixed to the platen 44 and which extends in a direction perpendicular to the support arm 46 in a plane parallel with the plane of the arms 46.

Figure 10:
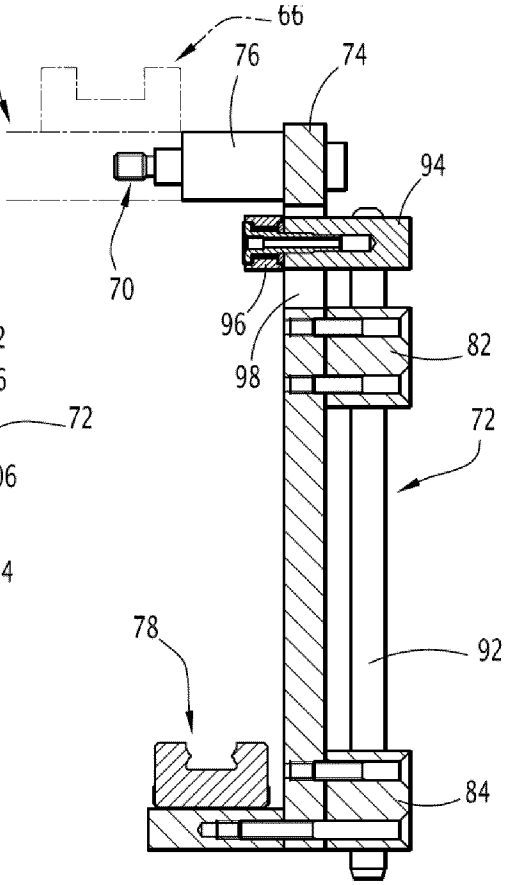
FIG. 10 is a sectional view of the transmission element illustrated in FIG. 8 in accordance with a section plane X-X illustrated in FIG. 8.
Figure 9:
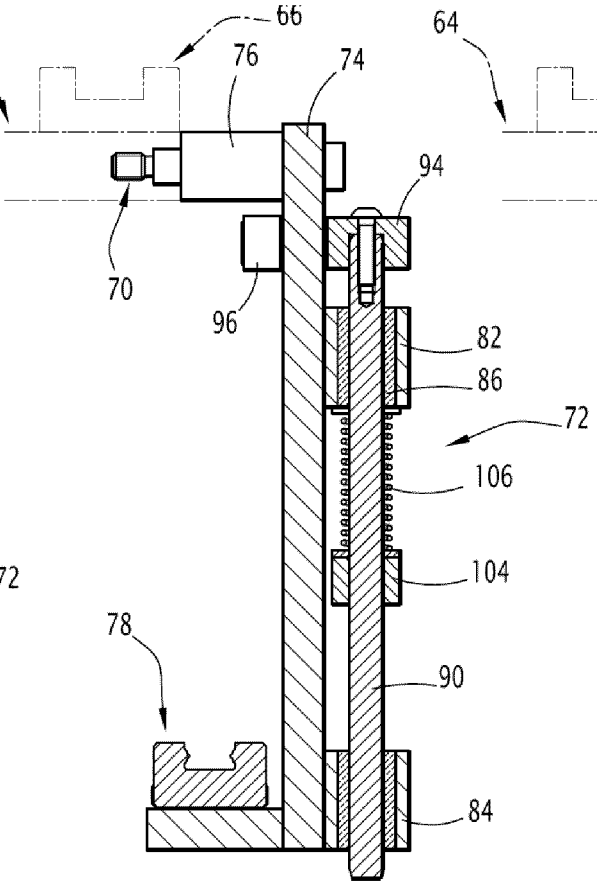
FIG. 9 is a sectional view of the transmission element illustrated in FIG. 8 in accordance with a section plane IX-IX illustrated in FIG. 8.
Figure 8:
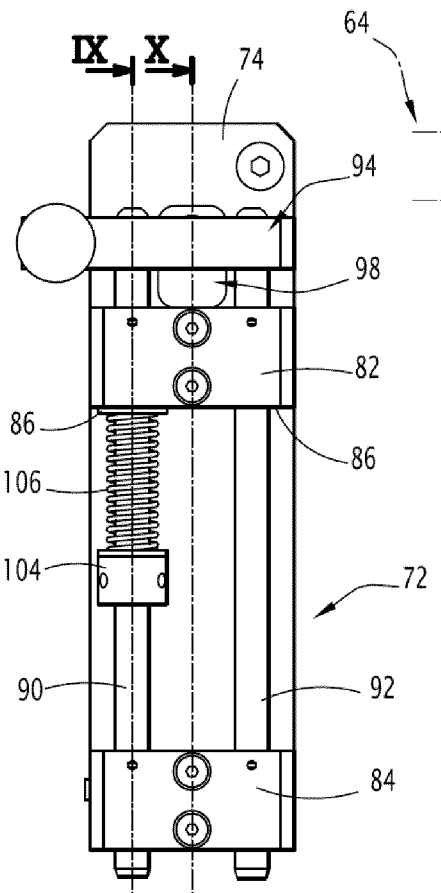
FIG. 8 is a front view of a transmission element of the transfer device.

The slide 66 is connected by a screw-type connection 70 to a transmission element 72 which is visible in FIGS. 9 and 10.

With reference to FIGS. 2 and 7 to 10, the transmission element 72 comprises a rectangular support plate 74 which is provided with a rod 76 for connection to the screw-type means 70 of the lifting block, and a slide 78 which is guided in a rail 80 which extends along the lower edge of the support platen 44.

The housings 34 of the connection support 32 of the drive means are capable of receiving the columns 90, 92 and moving them in a direction parallel with the rail 80.

An upper block 82 and a lower block 84 are fixed at the upper portion and lower portion of the support plate 74. Each block 82, 84 has two vertical through-holes 86, 88, in which two columns 90, 92 are guided.

A connection piece 94 is mounted so as to be fixedly joined to the upper end of the columns 90 and 92. The piece 94 is capable of moving into abutment against the upper block 82 when the columns 90, 92 are not carried by the connection support 32.

The piece 94 is provided with a locking roller 96 which extends through an opening 98 of the plate 74.

The locking roller 96 is capable of moving along a ledge 100 which is fixed to the support platen 44 and which can be seen in FIG. 2. The ledge 100 comprises two notches 102, in which the locking roller 96 can be received in order to prevent movement of the transmission element 72 in the Y direction and thereby to prevent movement of the lifting block 64 and, in that manner, the driving arms 62.

The notches are formed at a position corresponding to the travel end position of the transmission element 72.

A ring 104 is fixed to the column 90 so as to be provided between the upper block 82 and the lower block 84. A commachineion spring 106 is fixedly joined to the upper block 82 and the ring 104. That spring 106 is capable of drawing the column 90 towards the lower block 84 and thereby to move the locking roller 96 into a notch 102.

The transfer device 22 further comprises a detector for the number of movements of the driving arms 62 (not illustrated in the FIGS.).

Figure 11:
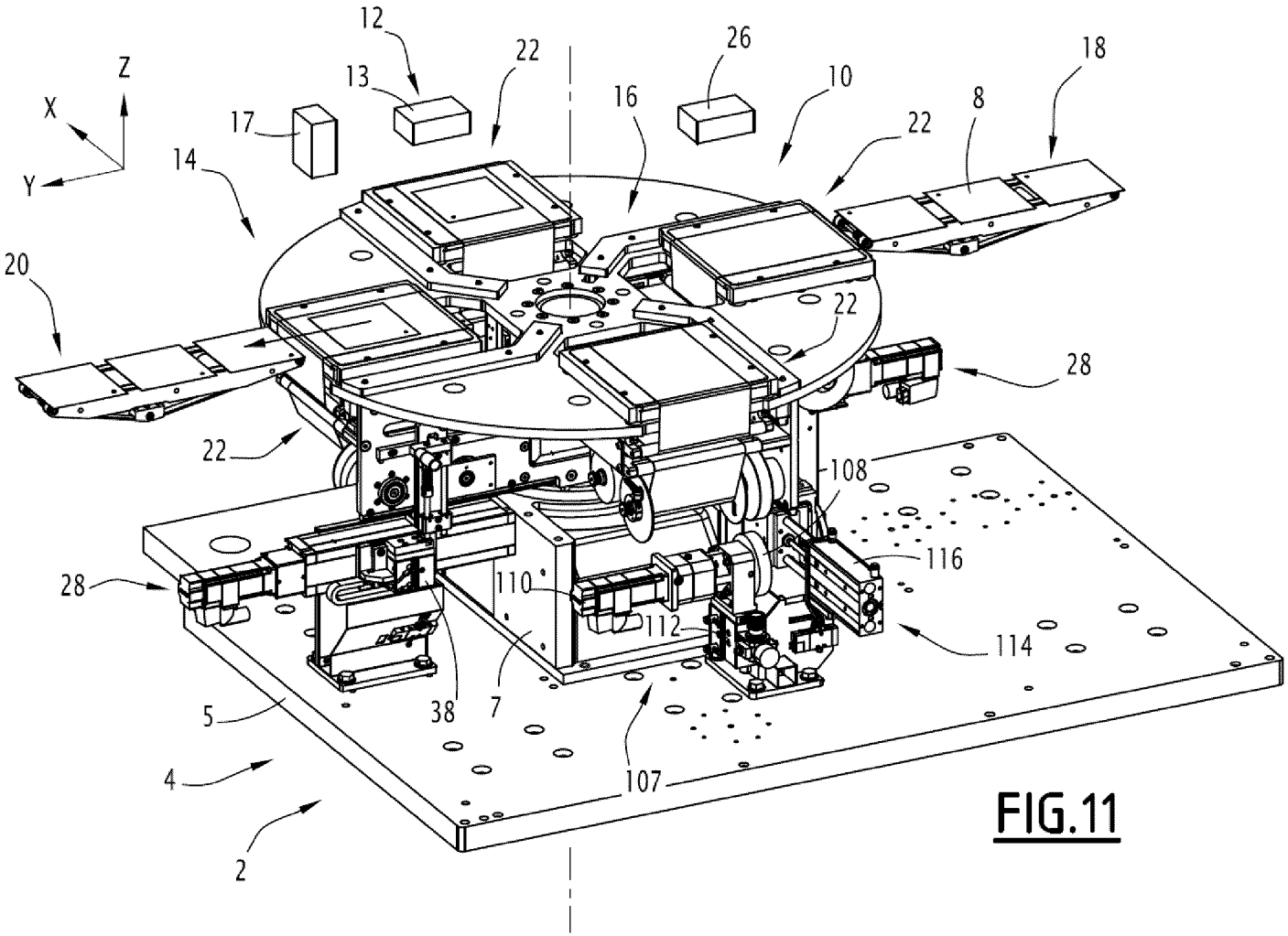
FIG. 11 is a perspective view of the face of the printing machine opposite the face illustrated in FIG. 1.

The printing machine 2 further comprises a device 107 for driving the second reel 50, illustrated in FIG. 11. The driving device 107 is arranged at the discharge station 16 and is carried by the support 5.

It comprises a wheel 108 for driving the bell-like member 54 of the transfer device in rotation, a step-down motor 110 which is capable of driving the wheel 108 and a pneumatic jack 112 which is capable of lifting the wheel 108 so that it moves into contact with the bell-like member 54.

The control unit 26 is capable of controlling the step-down motor 110 and the jack 112 in order to drive the second reel 50 in rotation in a winding direction, and the electromagnetic brake 52 in order to authorise the unwinding of the first reel 48, when the number of movements of the driving arms 62 exceeds a defined threshold or when the paper web 40 is soiled or damaged.

The printing machine 2 further comprises drive means 114 for the transfer devices 22.

Unlike the drive means 28 with which the stations 12 and 14 are provided, the drive means 114 comprise a pneumatic jack 116 which is capable of moving the connection support 32 in the Y direction and a pneumatic jack which cannot be seen in the FIGS. which is capable of moving the connection support 32 in the Z direction.

The drive means 114 are controlled by the control unit 26 so as to be actuated only when the object is broken.

During operation, an object 8 to be printed is moved by the introduction conveyor 18 as far as the transfer device 22 which is provided at the introduction station 10.

The control unit 26 controls the pneumatic jack 38 so that it lifts the connection support 32.

When the connection support 32 is moved vertically in accordance with a first trajectory, the housings 34 become engaged around the columns 90, 92. Subsequently, when the connection support 32 is moved vertically in accordance with a second trajectory, the locking roller 96 which is fixedly joined to the columns 90, 92 is moved out of the notch 102.

Subsequently, the control unit 26 controls the step-down motor 36 so that the connection support 32 is moved in the Y direction. The connection support 32 drives the columns 90, 92 so as to move in the Y direction and, in that manner, the driving arms 62 of the lifting block via the rod 76.

The movement of the driving arms 62 in the fourth plane brings about the movement of the web portion 40 between the support arms 46 and around the rollers 60.

The movement speed of the web portion 40 is two times greater than the movement speed of the driving arms 62 of the lifting block.

Since the speed and acceleration of the carrying webs 25 are equal to the speed and acceleration of movement of the web portion 40, the object is moved from the introduction conveyor 10 to the transfer device 22 without being broken and without the object moving relative to the transport webs 25 and the introduction conveyor 18, which allows the object to be positioned precisely on the web portion 40 in order to be printed.

When the connection support 32 is at the end of travel, the control unit 26 controls the pneumatic jack 38 so that it is lowered. The columns 90, 92 which are driven by their own weight and by the action of the spring 106 are lowered. The locking roller 96 which is fixedly joined to the columns is also lowered and is snap-fitted in the notch 102 so that the transmission element 72 is locked in terms of translation along the Y axis.

Subsequently, the control unit 26 controls the rotational movement of the tower 6 so that the transfer device 22 carrying the object 8 is moved to the printing station 12.

The object to be printed is then printed.

Subsequently, the control unit 26 controls the drive means of the tower 6 so that the transfer device 22 carrying the object is moved to the discharge station 14.

When the object has not been damaged, the control unit 26 controls the pneumatic jack 38 of the discharge station 14 in order to lift the connection support 32 and to connect it to the columns 90, 92 and finally to remove the locking roller 96 from the notch 102.

Subsequently, the control unit 26 controls the step-down motor 36 of the drive means 28 which are arranged at the discharge station 14 so that the connection support 32 is moved in a direction counter to the Y direction so that the object 8 to be printed is transferred from the transfer device 22 to the carrying webs 25 of the discharge conveyor 20.

When the camera 17 and its associated processing means establish that the object 8 to be printed is damaged or broken, the control unit 26 does not actuate the pneumatic jack 38 and the step-down motor 36 of the discharge station 14.

In that case, the control unit 26 actuates the rotation of the tower 6 so that the transfer device 22 is moved to the discharge station 16.

Subsequently, the control unit 26 controls the pneumatic jacks 38 of the drive means 114 which are provided at the discharge station 16 so that the transfer device moves the damaged object into a waste container which is not illustrated.

When the detector has detected that the web portion 40 has carried out a predetermined number of transfers, the web portion 40 is renewed in order to prevent it from tearing or to prevent it from soiling the objects to be printed.

To that end, the control unit 26 controls the electromagnetic brake 52 so that it allows rotation of the first reel 48. In a parallel manner, the control unit 26 controls the jack 112 in order to lift the drive wheel 108 so that it moves into contact with the bell-like member 54.

Subsequently, the control unit 26 controls the step-down motor 110 in order to move the wheel 108 in rotation. The wheel 108 drives in rotation the bell-like member 54 and the second reel 50 which is fixedly joined to the bell-like member 54 until the assembly of the web portion 40 previously used is wound around the second reel 50.

Advantageously, the printing machine according to the invention allows thin objects to be printed (of less than 1 mm) to be transported without breaking them without using a paper web, the paper web being changed only when the paper is worn or soiled.

Advantageously, the driving arms 62 drive the web portion 40 so that it moves at a speed and with acceleration equal to the speed and acceleration of the carrying webs 25 of the conveyors 18, 20 so that the object 8 is not damaged when it is moved from a conveyor towards a transfer device 22.

Advantageously, the drive means 28 of the conveyor web portion 40 are not carried by the tower 6, which reduces the weight and the spatial requirement of the tower.

Advantageously, whatever the position of the web on the rollers (that is to say, the entire web wound on the first reel 48 or the entire web wound on the second reel 50), the conveyor web portion 40 is always moved at the same speed and over the same trajectory.

Advantageously, the movement speed of the conveyor web can readily be modified.

Advantageously, the drive means 114 do not comprise any control device. They are capable of moving the web portion 40 at any speed independent of the movement speed of the carrying webs 25. Consequently, the printing machine 2 costs less than the printing machines of the prior art.

Advantageously, the movement of the web portion 40 is adjusted in order to correspond precisely to the movement of the carrying webs 25 which are moved sequentially by the step motor. In this manner, the objects are not subject to friction against the web portion 40, do not slide, do not pivot about themselves when they move from the conveyor 18 to the transfer device 22. In this manner, those objects may be positioned precisely and constantly on the web portion 40 in order to be printed. Similarly, the objects are positioned with constant spacing on the discharge conveyor 20, this spacing being equal to the spacing which exists between the objects on the introduction conveyor 18. Compliance with this distance between the objects facilitates subsequent automatic processing thereof.

The invention claimed is:

1. A printing machine (2), comprising:

a frame (4, 5, 7);

a tower (6) which is carried by the frame (4, 5, 7), the tower (6) being drivable in rotation relative to the frame (4, 5, 7) about an axis of rotation A-A in order to move an object (8) to be printed between at least a printing station (12), an introduction station (10), and a discharge station (14, 16) for the object to be printed;

first and second conveyors (18, 20) which are carried by the frame (4, 5, 7) and are respectively configured i) to introduce the object (8) to be printed to the introduction station (12), and ii) to discharge the object (8) from the discharge station (14, 16);

a transfer device (22) which is carried by the tower (6), the transfer device (22) comprising a conveyor web portion (40) which is configured to move the object (8) to be printed between the first and second conveyors (18, 20) and the tower (6);

a printing device (13) which is configured to print the object (8) to be printed, the printing device (13) being provided at the printing station (12); and first drive means (28) that drive the conveyor web portion (40) of the transfer device, the first drive means (28) being carried by the frame (4, 5, 7) and not carried by the tower such that the first drive means (28) are not movable in rotation with the tower, the transfer device (22) comprising a transmission element (72) that engages with the first drive means (28) when the transmission element is at the introduction station or at the discharge station, and disengages from the first drive means (28) when the transmission elements is at the printing station, wherein each of the first and second conveyors (18, 20) comprises at least one web (25) for carrying the object (8) to be printed, and wherein the first conveyor (18) is configured to move the object (8) as far as the transfer device (22).

2. The printing machine (2) according to claim 1, wherein the transfer device (22) comprises:

a support platen (44), two arms (46) for supporting the conveyor web portion (40) which are fixed to the support platen (44), the support arms (46) being parallel, two arms (62) for movingly driving the conveyor web portion (40), the driving arms (62) being capable of moving relative to the support platen (44), and retention means (52, 53) which are capable of maintaining the conveyor web portion (40) tensioned between the support arms (46) and the driving arms (62), the conveyor web portion (40) being in contact with an outer face of each support arm (46) and with an inner face of each driving arm (62).

3. The printing machine (2) according to claim 2, further comprising:

a unit (26) for controlling the first and second conveyors (18, 20) and the first drive means (28), the control unit (26) being capable of adjusting the speed and acceleration of the driving arms (62) to the speed and acceleration of the carrying web (25).

4. The printing machine (2) according to claim 3, wherein the control unit (26) is capable of actuating a movement speed of the driving arms (62) equal to half of the movement speed of the carrying web (25).

5. The printing machine (2) according to claim 2, wherein the transfer device (22) comprises a device for renewing the conveyor web portion (40) comprising:

a first reel (48) which is fixed to the support plate (44), a web portion which is intended to transport the objects (8) to be printed being wound around the first reel (48), a second reel (50) which is fixed to the support plate (44), a web portion which has transported the objects (8) to be printed being wound around the second reel (50); the web portion wound on the first reel (48), the conveyor web portion (40) and the web portion wound on the second reel (50) forming a continuous paper web, and wherein the retention means (52, 53) are capable of being unlocked in order to authorize rotation of the first reel (48) at least in an unwinding direction, and rotation of the second reel (50) at least in a winding direction in order to renew the conveyor web portion (40).

6. The printing machine (2) according to claim 5, wherein the retention means (52, 53) comprise an electromagnetic brake (52) with which the first reel (48) is provided and a free wheel (53) with which the second reel (50) is provided.

7. The printing machine (2) according to claim 4, wherein the transmission element (72) is connected to the driving arms (62), and wherein the first drive means (28) comprise:

a connection element (32) which is capable of being connected to the transmission element (72);

first movement means (36) which are capable of moving the connection element (32) in a first direction (Z) over a first trajectory in order to connect and disconnect the connection element (32) to/from the transmission element (72); and second movement means (38) which are capable of driving the connection element (32) so as to move in a second direction (Y) different from the first direction (Z) in order to move the driving arms (62) in accordance with a back and forth movement when the connection element (32) is connected to the transmission element (72).

8. The printing machine (2) according to claim 7 taken in combination, wherein the transmission element (72) comprises:

a support plate (74) which is capable of moving relative to the support platen (44) in the second direction (Y); and at least one column (90, 92) which is carried by the support plate (74), the or each column (90, 92) being capable of moving relative to the support platen (44) in the first direction (Z) and second direction (Y).

9. The printing machine (2) according to claim 8, wherein the transfer device (22) comprises locking means (96, 102, 106) which are capable of locking the driving arms (62) in terms of movement in the second direction (Y) when the driving arms (62) are in at least a travel end position of the back and forth movement.

10. The printing machine (2) according to claim 9 taken in combination, wherein the locking means comprise:

a locking roller (96) which is fixedly joined to the or each column (90, 92);

at least one notch (102) which is formed in the support platen (44) and which is capable of receiving the locking roller (96); and resilient means (106) which are capable of moving the locking roller (96) into the or each notch (102), the resilient means (106) being fixed to the column (90, 92) and to the support plate (74).

11. The printing machine (2) according to claim 10, wherein the first movement means (36) are capable of moving the connection element (32) along a second trajectory at the travel start and/or end of the back and forth movement of the driving arms (62) in order to move the locking roller (96) out of the or each notch (102).

12. The printing machine (2) according to claim 5, wherein the machine comprises a device (107) for driving in rotation the second reel (50) in a winding direction, the driving device (107) being fixedly joined to the frame (4, 5 7).

13. The printing machine (2) according to claim 12, wherein the transfer device (22) comprises:

a detector for the number of back and forth movements of the driving arms (62); and a control unit (26) which is capable of actuating the device (107) for driving the second reel (50) and the unlocking of the retention means (52, 53) when the detected number exceeds a defined threshold.

14. The printing machine (2) according to claim 3, wherein the transfer device (22) comprises a device for renewing the conveyor web portion (40) comprising:

a first reel (48) which is fixed to the support plate (44), a web portion which is intended to transport the objects (8) to be printed being wound around the first reel (48), a second reel (50) which is fixed to the support plate (44), a web portion which has transported the objects (8) to be printed being wound around the second reel (50); the web portion wound on the first reel (48), the conveyor web portion (40) and the web portion wound on the second reel (50) forming a continuous paper web, and wherein the retention means (52, 53) are capable of being unlocked in order to authorize rotation of the first reel (48) at least in an unwinding direction, and rotation of the second reel (50) at least in a winding direction in order to renew the conveyor web portion (40).

15. The printing machine (2) according to claim 4, wherein the transfer device (22) comprises a device for renewing the conveyor web portion (40) comprising:

a first reel (48) which is fixed to the support plate (44), a web portion which is intended to transport the objects (8) to be printed being wound around the first reel (48), a second reel (50) which is fixed to the support plate (44), a web portion which has transported the objects (8) to be printed being wound around the second reel (50); the web portion wound on the first reel (48), the conveyor web portion (40) and the web portion wound on the second reel (50) forming a continuous paper web, and wherein the retention means (52, 53) are capable of being unlocked in order to authorize rotation of the first reel (48) at least in an unwinding direction, and rotation of the second reel (50) at least in a winding direction in order to renew the conveyor web portion (40).

16. The printing machine (2) according to claim 2, wherein the transmission element (72) is connected to the driving arms (62), and wherein the first drive means (28) comprise:

a connection element (32) which is capable of being connected to the transmission element (72);

first movement means (36) which are capable of moving the connection element (32) in a first direction (Z) over a first trajectory in order to connect and disconnect the connection element (32) to/from the transmission element (72); and second movement means (38) which are capable of driving the connection element (32) so as to move in a second direction (Y) different from the first direction (Z) in order to move the driving arms (62) in accordance with a back and forth movement when the connection element (32) is connected to the transmission element (72).

17. The printing machine (2) according to claim 3, wherein the transmission element (72) is connected to the driving arms (62), and wherein the first drive means (28) comprise:

a connection element (32) which is capable of being connected to the transmission element (72);

first movement means (36) which are capable of moving the connection element (32) in a first direction (Z) over a first trajectory in order to connect and disconnect the connection element (32) to/from the transmission element (72); and second movement means (38, 116) which are capable of driving the connection element (32) so as to move in a second direction (Y) different from the first direction (Z) in order to move the driving arms (62) in accordance with a back and forth movement when the connection element (32) is connected to the transmission element (72).

18. The printing machine (2) according to claim 5, wherein the transmission element (72) is connected to the driving arms (62), and wherein the first drive means (28) comprise:

a connection element (32) which is capable of being connected to the transmission element (72);

first movement means (36) which are capable of moving the connection element (32) in a first direction (Z) over a first trajectory in order to connect and disconnect the connection element (32) to/from the transmission element (72); and second movement means (38, 116) which are capable of driving the connection element (32) so as to move in a second direction (Y) different from the first direction (Z) in order to move the driving arms (62) in accordance with a back and forth movement when the connection element (32) is connected to the transmission element (72).

19. The printing machine (2) according to claim 6, wherein the transmission element (72) is connected to the driving arms (62), and wherein the first drive means (28) comprise:

a connection element (32) which is capable of being connected to the transmission element (72);

first movement means (36) which are capable of moving the connection element (32) in a first direction (Z) over a first trajectory in order to connect and disconnect the connection element (32) to/from the transmission element (72); and second movement means (38, 116) which are capable of driving the connection element (32) so as to move in a second direction (Y) different from the first direction (Z) in order to move the driving arms (62) in accordance with a back and forth movement when the connection element (32) is connected to the transmission element (72).

20. The printing machine according to claim 1, further comprising:

a station for discharging damaged objects (16); and second drive means (114, 116) separate from the first drive means (28), the second drive means (114, 116) being carried by the frame (4, 5, 7) and not carried by the tower such that the second drive means are not movable in rotation with the tower, wherein, upon a detection at the discharge station (14) that the printed object (8) is damaged, the transfer device (22) is moved by the tower (6) to the station for discharging damaged objects (16) where the second drive means (114, 116) are arranged so that the transfer device (22) evacuates the damaged object out of the machine.

* * * * *